US010087580B2

(12) United States Patent
Ben et al.

(10) Patent No.: US 10,087,580 B2
(45) Date of Patent: Oct. 2, 2018

(54) DRY MIXED RE-DISPERSIBLE CELLULOSE FILAMENT/CARRIER PRODUCT AND THE METHOD OF MAKING THE SAME

(71) Applicant: FPINNOVATIONS, Pointe-Claire (CA)

(72) Inventors: Yuxia Ben, Kirkland (CA); Gilles Dorris, Vimont-Laval (CA); Xiaolin Cai, Kirkland (CA); Xujun Hua, Kirkland (CA); Zhirun Yuan, Pointe-Claire (CA); Patrick Neault, Les Coteaux (CA)

(73) Assignee: FPInnovations, Pointe-Claire QC (CA)

( * ) Notice: Subject to any disclaimer, the term of this patent is extended or adjusted under 35 U.S.C. 154(b) by 260 days.

(21) Appl. No.: 15/137,353

(22) Filed: Apr. 25, 2016

(65) Prior Publication Data

US 2016/0319482 A1 Nov. 3, 2016

Related U.S. Application Data

(60) Provisional application No. 62/155,583, filed on May 1, 2015.

(51) Int. Cl.
*D21C 9/18* (2006.01)
*D21H 11/02* (2006.01)
(Continued)

(52) U.S. Cl.
CPC ..... *D21C 9/18* (2013.01); *D21H 11/02* (2013.01); *D21H 11/08* (2013.01); *D21H 11/10* (2013.01);
(Continued)

(58) Field of Classification Search
None
See application file for complete search history.

(56) References Cited

U.S. PATENT DOCUMENTS 4,374,702 A 2/1983 Turbak et al.
4,378,381 A 3/1983 Turbak et al.
(Continued)

FOREIGN PATENT DOCUMENTS

CA 2799123 9/2013
CN 102817276 10/2014
(Continued)

OTHER PUBLICATIONS

Barr-Rosin, division of GEA Canada Inc. "Drying Systems and Energy Integration", pp. 1-52, May 12, 2012.
(Continued)

*Primary Examiner* — Melvin C. Mayes
*Assistant Examiner* — Stefanie J Cohen
(74) *Attorney, Agent, or Firm* — Norton Rose Fulbright Canada LLP

(57) ABSTRACT

The present description relates to a process of producing a dry mixed product comprising cellulose filament (CF) and a carrier fiber, and a dry mixed product of re-dispersible cellulose filament and a carrier fiber that permits the CF to retain its dispersibility in water and hence superior reinforcement ability in papermaking furnishes, composite materials, or other materials where CF is used. The process comprises mixing a water suspension of never-dried CF with a cellulose fiber pulp carrier followed by thickening to a suitable concentration so that it can be further processed and dried in a conventional device such as a dryer can of a pulp machine or a flash dryer.

16 Claims, 7 Drawing Sheets

(51) Int. Cl.

| | |
|---|---|
| ***D21H 11/08*** | (2006.01) |
| ***D21H 27/02*** | (2006.01) |
| ***D21H 27/10*** | (2006.01) |
| ***D21H 11/10*** | (2006.01) |
| ***D21H 15/06*** | (2006.01) |

(52) U.S. Cl.
CPC ..... *D21H 15/06* (2013.01); *D21H 27/02* (2013.01); *D21H 27/10* (2013.01)

(56) References Cited

U.S. PATENT DOCUMENTS

| | | | | |
|---|---|---|---|---|
| 4,481,076 | A | 11/1984 | Herrick | |
| 6,183,596 | B1 | 2/2001 | Matsuda et al. | |
| 6,214,163 | B1 | 4/2001 | Matsuda et al. | |
| 6,602,994 | B1 | 8/2003 | Cash et al. | |
| 8,372,320 | B2 | 2/2013 | Gardner et al. | |
| 2013/0000855 | A1 | 1/2013 | Nuopponen et al. | |
| 2013/0017394 | A1* | 1/2013 | Hua ..... | D21D 1/20 428/401 |
| 2013/0345416 | A1 | 12/2013 | Laukkanen et al. | |
| 2015/0141531 | A1 | 5/2015 | Bras et al. | |

FOREIGN PATENT DOCUMENTS

| | | |
|---|---|---|
| EP | 1859082 | 8/2010 |
| EP | 2511346 | 10/2012 |
| WO | 2012097446 | 7/2012 |
| WO | 20120107642 | 8/2012 |
| WO | 20140001699 | 1/2014 |
| WO | 2014071523 | 5/2014 |
| WO | 2014085730 | 6/2014 |

OTHER PUBLICATIONS

Shatkin et al., Tappi Journal, 13(5):9-16 and 13(6):57-69 (2014).
Saito et al., 2006 Biomacromolecules, 7:1687-1691.
Saito et al., 2007 Biomacromolecules, 8:2485-2491.
Saito et al., 2009 Biomacromolecules, 10:1992-1996.
Da Silva Perez et al., 2010 TAPPI Nano 2.
Diniz et al., (Wood Sc. Technol, 37:489-494, 2004.
Vartiainen et al., 2011, Cellulose, 18:775-786.
Peng et al., 2012, Cellulose 19(1): 91-102.
Eyholzer et al., Cellulose, 17:19-30, 2010.
English language Abstract of CN 102817276.
English language Abstract of WO 20140001699.
International Search Report dated Jun. 23, 2016 corresponding to PCT/CA2016/050475.

* cited by examiner

DRY MIXED RE-DISPERSIBLE CELLULOSE FILAMENT/CARRIER PRODUCT AND THE METHOD OF MAKING THE SAME

BACKGROUND i) Field

The present relates to a new dry mixed product having re-dispersible cellulose filaments associated physically with a carrier and the method for producing this dry mixed product. The method of producing the dry mixed product begins with cellulose filaments and their incorporation into/onto a wet carrier, such as wood or other plant pulps. Surprisingly, the wet mixed cellulose filament/pulp product can be dried in conventional drying equipment without the cellulose filaments losing their re-dispersible property.

ii) Description of the Prior Art

There is considerable amount of research and development activities worldwide to isolate and commercialize cellulose-based nano- or quasi-nano suprastructures from wood, plant, marine animals, algae and bacteria sources to improve existing materials or to design and develop a variety of entirely new products in a wide variety of applications and markets as described by Shatkin et al (Tappi Journal, 13(5):9-16 and 13(6):57-69 (2014)). Cellulose nanofilaments (CNF) disclosed by Hua et al (CA 2,799,123), defined herein and referred to as cellulose filaments (CF), have in a preferred embodiment lengths of over 100 μm and a width in submicron range. The CF can be produced by multi-pass high consistency refining of wood or plant fibres such as a bleached softwood kraft pulp as described by Hua et al in US Pat. Application No. 20130017394 incorporated herein by reference. The CF is structurally different from other cellulose fibrils such as microfibrillated cellulose (MFC), nanofibrillated cellulose (NFC), or nanocellulose in that it comprises high-aspect-ratio cellulose fibrils physically detached from each other, and from parent fibres, while MFC or NFC are either fibril bundles or short fibrils, typically less than 1 micrometer. CF exhibits exceptional reinforcement properties due to their high aspect ratio which can exceed 1000, that is much higher than microfibrillated or nanofibrillated cellulose, or cellulose nanofibrils prepared using other mechanical methods (Turbak et al 1983, U.S. Pat. No. 4,374,702; Matsuda et al 2001, U.S. Pat. No. 6,183,596; Choi et al 2010, EP 1 859 082 B1; Laukkanen et al 2013, US Pat. Application No. 2013/0345416 A1). CF is generally made at consistencies greater than 20%, preferably between 30 and 45% fibre suspension with addition of water (US Pat. No. 2013/0017394). Most other methods to produce MFC/NFC are typically carried out in aqueous suspensions at fibre consistencies lower than 10% and preferably in the 1-6% range (Matsuda et al 2001, U.S. Pat. No. 6,183,596; U.S. Pat. No. 6,214,163; Li et al 2012, CN 2012-10282759; Bras et al 2014, WO 2014/001699 A1; Saito et al 2006 Biomacromolecules, 7:1687-1691; 2007 Biomacromolecules, 8:2485-2491; 2009 Biomacromolecules, 10:1992-1996; Da Sil Va Perez et al 2010 TAPPI Nano 2). The resultant final products of MFC/NFC made at low consistency have a gel-like structure (Turbak et al 1983, U.S. Pat. No. 4,374,702) whereas CF made above 20% consistency has a semi-dry wood pulp-like appearance but still contains a substantial amount of residual water after manufacturing.

Ideally, commercial nanocellulosic or quasi-nano cellulosic materials should be transported to end-user's location in a fully dry form in order to reduce shipping cost and to provide long product shelf-life. However, the difficulty of preparing dry products without decreasing their dispersibility in aqueous media represents a serious impediment to their successful commercialization. This drying issue which is shared by all cellulose microfibrils and nanofibrils is generally ascribed to so-called hornification phenomenon which impairs mechanical properties as discussed by Diniz et al (Wood Sc. Tehcnol, 37:489-494, 2004). In the field of wood pulp making, hornification describes changes in fibre morphology after wood pulp fibres have been dried for the first time. Hornification is attributed to many factors which include the formation of irreversible hydrogen bonds (H-bonds) and/or the formation of lactone bridges. Hornification provokes agglomeration of fibrils via self-assembly and therefore represents an obstacle to the recovery of the quasi- or true nanometric dimensions of never-dried cellulose fibrils when these materials are re-mixed in water using conventional low and medium consistency pulpers. Indeed, a dense assembly of dry fibrils hampers water penetration and the break-down of hydrogen bonds holding the structure together.

To avoid hornification of microfibrillated cellulose (MFC) or nanofibrillated cellulose (NFC), several physicochemical approaches can be used like: (1) supercritical drying, spray drying or freeze drying, (2) use of additives that prevent or reduce hydrogen bonds, (3) rendering MFC/NFC more hydrophobic via chemical modification, or (4) formation of thin webs on paper machine.

In the first category, Turbak et al disclosed a method to produce microfibrillated cellulose where the microfibrillated cellulose was dried by carbon dioxide critical point drying (U.S. Pat. No. 4,374,702 and U.S. Pat. No. 4,378,381). The supercritical drying process is complicated by solvent replacement and the costs are high, with scale up thought to be impractical.

Oven drying, freeze drying, supercritical drying, and spray-drying methods were used to dry microfibrillated or nanofibrillated cellulose suspensions (Vartiainen et al, 2011, Cellulose, 18:775-786 and Peng et al, 2012, Cellulose 19(1): 91-102). Due to hornification of the MFC or NFC, fine and coarse aggregates of MFC or NFC were formed during these drying processes. However, the re-dispersibility of the dried aggregates of MFC or NFC in water was very poor.

In the category of additives, Herrick (U.S. Pat. No. 4,481,076) disclosed a method to produce re-dispersible microfibrillated cellulose using an additive capable of substantially inhibiting hydrogen bonding between the cellulose fibrils. The additive may be sucrose, glycerin, ethylene glycol and propylene glycol, sugar derivatives, starch, inorganic salts such as alkali metal salts of phosphates or borates. Each additive must be used in high amounts, generally between 50 to 100% of the dry weight of MFC. These compounds impair fibrils coalescence during water removal by covering them with a thick layer of water-soluble coating which once put back in water will dissolve to release the fibrils. Properties of never-dried MFC like viscosity can be partially restored with this approach, but the amount of additives needed is impractically high, and adds significantly extra costs to the microfibrillated cellulose products.

Nuopponen et al. (US Pat. No. 0000855 A1) added optical brightening agents (OBAs), such as stilbene, coumarin and pyrazoline compounds, in a process of manufacturing nanofibrillated cellulose pulp to inhibiting hydrogen bonding between cellulose fibrils, which can also create dispersive effect by reducing fibre-water and fibre-fibre bonding that occurs during drying process. It was shown that dried nanofibrillated cellulose pulp containing optical brightening agent dispersed better than the one without optical brightening agent, but the degree of dispersibility of the dried nanofibrillated cellulose pulp containing optical brightening agent was not clear. In addition, optical brightening agents are very expensive additives.

In the approach to render MFC/NFC more hydrophobic via chemical modification, Gardner et al (U.S. Pat. No. 8,372,320 B2) disclosed a drying method of producing dried cellulose nanofibrils comprising atomizing an aqueous suspension of cellulose nanofibrils and introducing the atomized aqueous suspension into a drying chamber of a drying apparatus. The aqueous suspension may include a surface modification agent, such as sodium silicate, fluorosilane, or ethanol, which prevents agglomeration of cellulose nanofibrils by reducing surface tension.

Laukkanen et al (WO2012/107642 A1 & U.S. Pat. 2013/0345416 A1) described a method to produce dried nanofibrillar cellulose by means of organic solvent exchange to remove water, followed by a drying process. Since a large volume of organic solvent is needed, this process to obtain dry nanofibrillar cellulose is not green nor economically viable.

In addition, Bras et al (WO 2014/001699 A1) described a process for manufacturing a fibrillated cellulose powder suitable for being dispersed in an aqueous medium. In this process, monovalent salt (5-20 mmol/l) from the group of sodium chloride, potassium chloride and lithium chloride was added to the fibrillated cellulose suspension and followed by a step of lyophilisation. The fibrillated cellulose suspension was pretreated by enzymatic or chemical such as carboxymethylation.

Eyholzer et al (Cellulose, 17:19-30, 2010) and Cash et al (U.S. Pat. No. 6,602,994 B1) disclosed methods to derivatize the microfibrillated or nanofibrillated cellulose with the introduction of various groups including carboxyl groups. However, the derivatization requires the use of large amounts of the reagent and it has not been established that derivatized MFC can be re-dispersed in water after drying.

A method to produce dry and re-dispersible CF without the need for additives or for the derivatization of cellulose was disclosed (Dorris et al, WO2014/071523 A1) incorporated herein by reference. It involves the formation and drying of a thin web on a fast paper machine. This method requires a paper machine, a very expensive piece of equipment. Although many such machines are idle and available for this purpose, many of these paper machines will eventually be dismantled. Moreover, need to re-dilute the product to form a thin web is an extra step which adds to drying cost.

There is, therefore, a need for developing a cost effective method for drying cellulose nanofilaments or cellulose filaments (CF) without losing their dispersibility in water and hence their superior reinforcement ability in papermaking furnishes, composite materials, or other materials.

SUMMARY

The present disclosure describes dry and water re-dispersible fibrillated, cellulose filaments carried by natural fibres are produced free of chemical additives and free of derivatization.

In accordance with one aspect described herein, there is provided a dry mixed product comprising a re-dispersible cellulose filament and a carrier fibre, the dry mixed product comprising a re-dispersible cellulose filament/carrier fibre weight ratio of about 1/99 to about 99/1, a humidity of less than 30 weight % and wherein the re-dispersible cellulose filaments are physically attached and reversibly integrated with the carrier fibre, permitting re-dispersion of the re-dispersible cellulose filaments in aqueous phase.

In accordance with another aspect, there is provided the dry mixed product herein described, wherein the weight ratio of the re-dispersible cellulose filaments/carrier is about 1/99 to about 50/50.

In accordance with another aspect, there is provided the dry mixed product herein described, wherein the weight ratio of the re-dispersible cellulose filaments/carrier is about 10/90 to about 30/70.

In accordance with another aspect, there is provided the dry mixed product herein described, wherein the humidity is less than 20 weight %.

In accordance with another aspect, there is provided the dry mixed product herein described, wherein the carrier fibre is selected from mechanical pulps, such as thermomechanical pulp, chemi-thermomechanical pulp, ground wood pulp or bleached chemi-thermomechanical pulp or chemical pulps, such as bleached softwood kraft pulp, hardwood kraft pulp, non-bleached kraft pulp and/or sulfite pulps.

In accordance with another aspect described herein, there is provided a process for producing a dry mixed product comprising a re-dispersible cellulose filament and a carrier fibre, comprising providing a cellulose filament; providing a carrier fibre; mixing the cellulose filament, the carrier and water to produce a mixed cellulose filament/carrier suspension; thickening the mixed cellulose filament/carrier suspension to produce a mixed cellulose filament/carrier pulp; fluffing the mixed cellulose filament/carrier pulp to produce a mixed cellulose filament/carrier fluff; drying the mixed cellulose filament/carrier fluff in the conventional pulp drying process to produce the dry mixed product, wherein the cellulose filament to the carrier is a weight ratio of about 1/99 to about 99/1, and the dry mixed product has a humidity of less than 30 weight %.

In accordance with another aspect of the process herein described, wherein the mixed cellulose filament/carrier pulp as a consistency of 20 to 50 weight % solids after a thickening step.

In accordance with another aspect of the process herein described, wherein the weight ratio of cellulose filament to the carrier is about 1/99 to about 50/50.

In accordance with another aspect of the process herein described, wherein the weight ratio of cellulose filament to the carrier is about 10/90 to about 30/70.

In accordance with another aspect of the process herein described, wherein the conventional pulp dryer is selected from the group consisting of a flash dryer, a spray dryer and steam dryer.

In accordance with another aspect of the process herein described, wherein the conventional pulp dryer is a flash dryer.

In accordance with another aspect described herein, there is provided a process of producing a reinforced paper, tissue and/or a packaging product comprising providing a dry mixed product herein described; providing a paper making pulp; re-dispersing cellulose filaments from the dry mixed product in water to produce a mixed product suspension; repulping the paper making pulp with water to make a repulp suspension combining the mixed product suspension with the repulp suspension to make a reinforced paper slurry, depositing the reinforced paper slurry to produce the reinforced paper, tissue and/or packaging product.

In accordance with another aspect of the process herein described, wherein the mixed product suspension with the repulp suspension are combined at a weight ratio of solids from 1/99 to 99/1.

In accordance with another aspect of a process for producing a reinforced product comprising providing a dry mixed product herein described, and mixing the dry mixed product with a starting material of the reinforced product.

In accordance with another aspect of the process herein described, wherein the reinforced product is selected from the group consisting of a composite material; a gypsum; a cement; a concrete product; a fibre board; a paint; and a coating.

In accordance with another aspect of the process herein described, wherein the mixed product is in a suspension with the starting material and combined in a weight ratio of solids from 1/99 to 99/1.

Surprisingly, the dry cellulose filaments in the carrier pulp do not lose their dispersibility in water upon mild mechanical agitation, because the carrier pulp in the liquid dispersion of cellulose filaments inhibits the formation of irreversible hydrogen bonds between the cellulose filaments during drying process.

Also unexpectedly the dried mixed product of re-dispersible cellulose filaments/carrier produced from the disclosed method has similar properties to never-dried cellulose filaments, with the same or superior reinforcement ability in papermaking furnishes, composite materials, or other materials where CF is applied.

The dry and water re-dispersible cellulose filaments described herein contain natural fibres, which include all wood and plant fibres produced by any methods, such as chemical and mechanical pulping methods. The ratio of cellulose filaments verse to natural fibres ranged from about 1/99 to about 99/1, preferably from the range of from about 1/99 to about 50/50, most preferably from the range of about 10/90 to about 30/70. The dry and water re-dispersible cellulose filaments in the carrier natural fibres are free of other additives and free of derivatization.

The raw materials described herein are the never-dried cellulose filaments which are produced by the method described in Hua et al. US Pat. Application No. 20130017394 by multi-pass, high consistency refining of wood or plant fibres such as bleached softwood kraft pulp.

The dry and water re-dispersible fibrillated, cellulose filaments have an average length of from about 200 μm to about 2 mm, an average width of from 30 nm to about 500 nm and an average aspect ratio of from about 200 to about 5000.

The method to produce dry and water re-dispersible CF comprises mixing a water suspension of never-dried CF with cellulose fibre pulp followed by thickening to a suitable concentration so that it can be further processed and dried in a device such as dryer cans of a pulp machine or a flash drier.

DETAILED DESCRIPTION

Prior to the present disclosure, no natural fibres have been used as additives for macrofibrillated cellulose, nanofibrillated cellulose or fibrillated cellulose materials during drying process. No dry and water re-dispersible fibrillated, cellulose materials carried by natural fibres have been reported.

Figure 1:
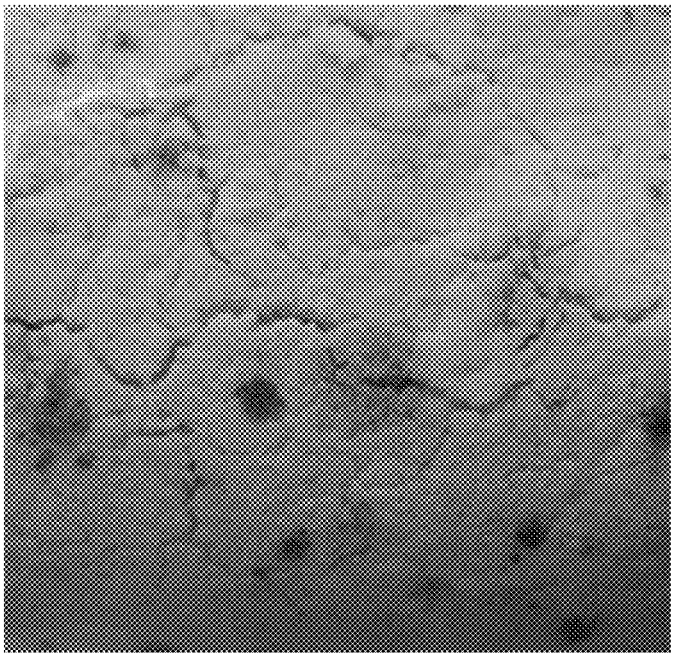
FIG. 1 (PRIOR ART)
FIG. 1 is the photograph of (wet) never-dried cellulose filaments (free of biocides) after 2-8 months storage, including dark coloured fungus visible after a certain period of storage time (PRIOR ART).

The never-dried (wet) cellulose filaments may develop dark colour fungus and lose their physical strength, after certain period of storage time, as shown in FIG. 1.

Figure 2:
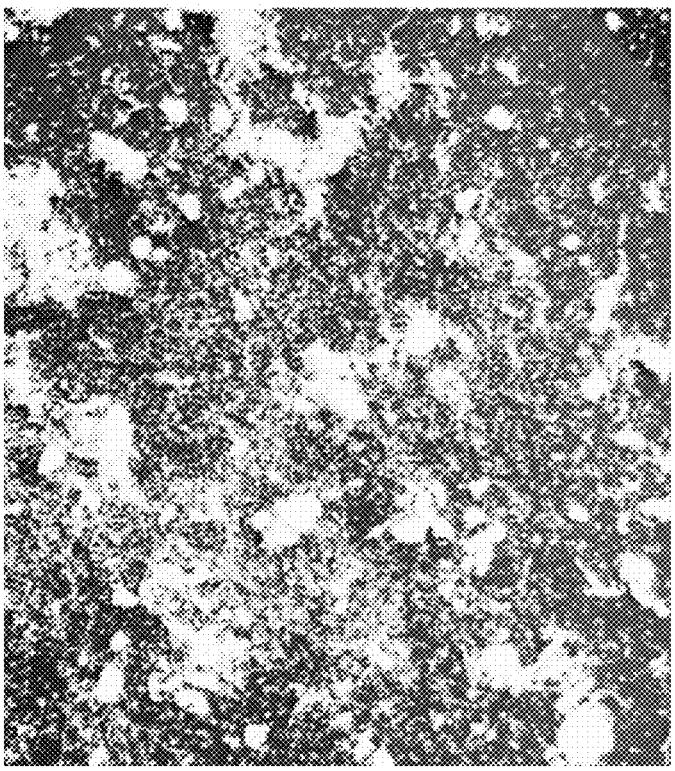
FIG. 2 (PRIOR ART)
FIG. 2 is a photograph of dried clumps of cellulose filaments formed during common drying methods, which are very difficult to be fully re-dispersed with normal dispersion and pulping equipment due to strong bonding between filaments upon drying (PRIOR ART).
Figure 3A:
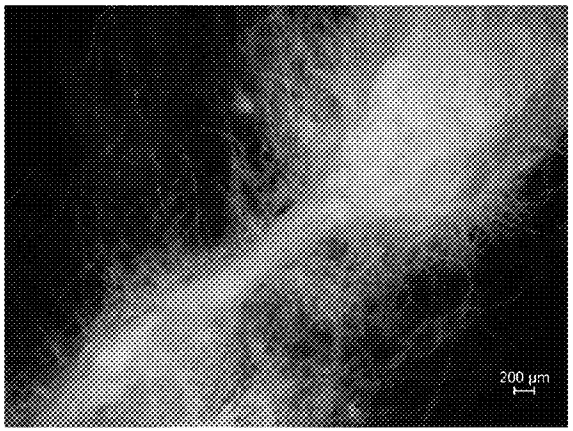
FIG. 3a (PRIOR ART)
FIG. 3*a* is a photograph of bundles of cellulose filaments formed during conventional drying process, which are very difficult to re-dispersed and that lose therein strengthening properties (PRIOR ART).
Figure 3C:
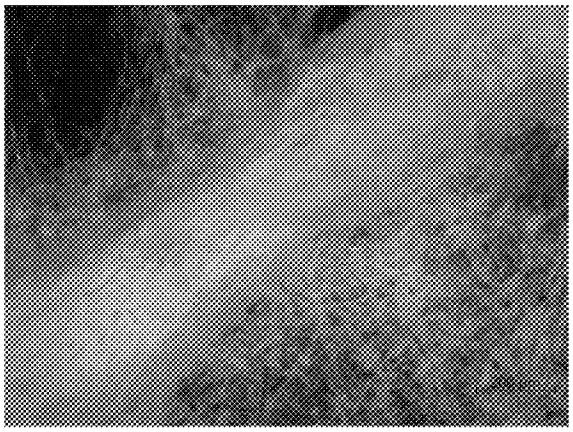
FIG. 3c (PRIOR ART)
FIG. 3*c* are the cellulose filaments of FIG. 3*a* of greater magnification (PRIOR ART).
Figure 3B:
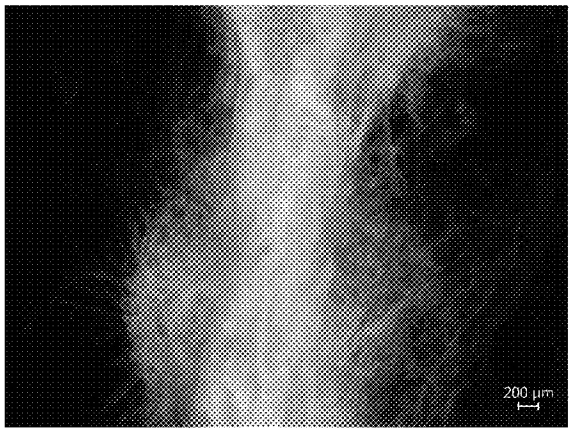
FIG. 3b (PRIOR ART)
FIG. 3*b* is a further photograph of bundles of cellulose filaments formed during conventional drying process, which are very difficult to re-dispersed and that lose therein strengthening properties (PRIOR ART).
Figure 3D:
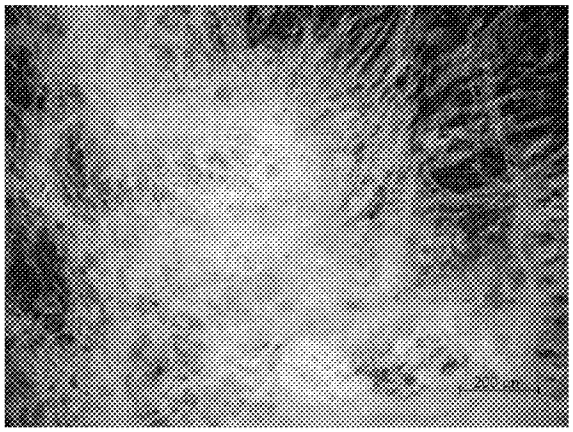
FIG. 3d (PRIOR ART)
FIG. 3*d* are the cellulose filaments of FIG. 3*b* of greater magnification (PRIOR ART).

All the conventional pulp drying methods, including but not limited to, air drying, flash drying, spray drying, rotary air drying have strong drawbacks for drying bulk high consistency cellulose filaments. The dried CFs produced from these drying methods form CF clumps, as shown in FIGS. 2-3, which are only partially re-dispersible in aqueous system. Therefore, the reinforcement power of the dried cellulose filaments with conventional drying approaches is much lower than that of never-dried cellulose filaments.

Dry cellulose filament materials are required in many potential applications. Compare to the never-dried cellulose filaments produced from the method of Hua et al. (US Pat. Application No. 20130017394), dry cellulose filaments have a longer shelf life and lower transportation cost.

Figure 4:
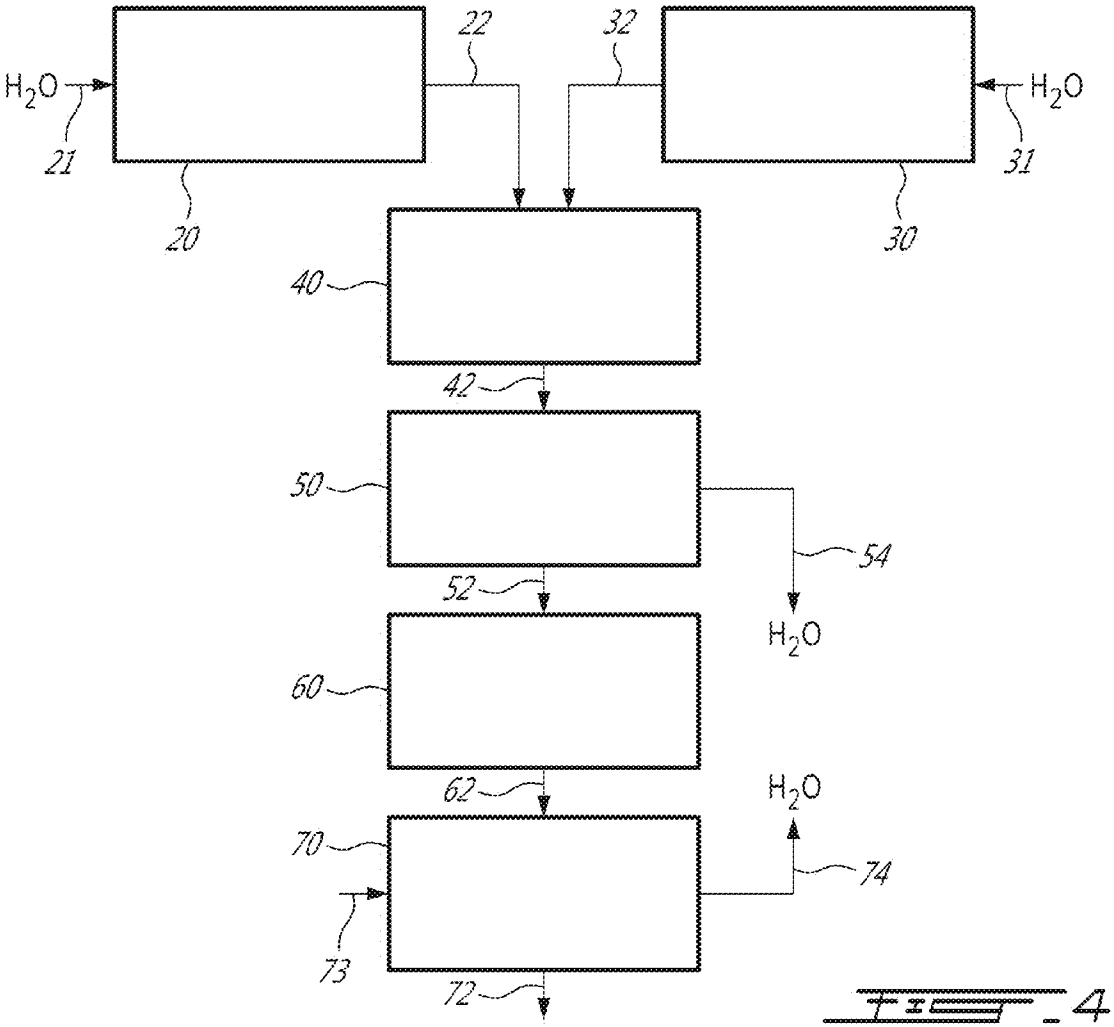
FIG. 4 is a process block diagram in accordance with one embodiment described herein.

FIG. 4 illustrates a process fluid diagram of one embodiment of the present method. Cellulose filaments 20 are prepared according to the method of Hua et al. Hot water 21 and mechanical agitation are generally required to make a suspension of cellulose filaments 22.

A carrier 30 that is generally a natural fibre or pulp is also provided in a dry or suspended form. Generally a carrier suspension 32 is prepared. The cellulose filament suspension 22 and carrier suspension 32 are mixed. The wet cellulose filament/carrier suspension 42 is then thickened with some water 54 removed from the suspension. The thickened cellulose filament/carrier pulp 52 is fluffed 60. The fluffed cellulose filament/carrier 62 is then dried 70 in any conventional pulp dryer thereby producing the dried cellulose filament/carrier product 72.

In the present disclosure described, dry and water re-dispersible fibrillated, cellulose filaments carried by natural fibres are produced and free of chemical additives and free of derivatization.

Surprisingly, it has been discovered that the dry cellulose filaments in the carrier pulp produced from the disclosed method do not lose their dispersibility in water upon mild mechanical agitation, because the natural fibres in the liquid dispersion of cellulose filaments inhibit the formation of irreversible hydrogen bonds (hornification) between the cellulose filaments during drying process.

Also unexpectedly, dried cellulose filaments produced from the disclosed method are similar to never-dried cellulose filaments, and do not lose their superior reinforcement ability in papermaking furnishes, composite materials, or other materials where CF is applied.

The dry and water re-dispersible cellulose filaments produced from the present process contains a certain amount of natural fibres. Any type of natural fibres, such as wood and plant fibres, can be used to inhibit the formation of irreversible hydrogen bonds between the cellulose filaments during drying process. The ratio of cellulose filaments verse to natural fibres ranged from 1/99 to 99/1, preferably in the range of from about 1/99 to about 50/50, most preferably in the range of about 10/90 to about 30/70. The dry and water re-dispersible cellulose filaments in the carrier natural fibres are free of other additives.

The never-dried cellulose filaments used herein have an average length of from about 200 μm to about 2 mm, an average width of from 30 nm to about 500 nm and an average aspect ratio of from about 200 to about 5000, and are produced as in US Pat. Application No. 20130017394 by multi-pass, high consistency refining of wood or plant fibres such as a bleached softwood kraft pulp. The CFs here are structurally very different from the other cellulose fibrils such as microfibrillated cellulose (MFC) or nanofibrillated cellulose (NFC) using other methods described in prior art. For example, the length and aspect ratio of the cellulose filaments are much higher than those of MFC and NFC produced using other methods described in prior art (U.S. Pat. No. 8,372,320 B2, U.S. Pat. No. 4,378,381). It is understood that in the production of fibrillated cellulose materials that cellulose filaments, like other fibrillated cellulose materials produced using mechanical means, are not a homogeneous material with one single dimension value, but includes a distribution of dimensional values.

In accordance with one aspect described herein, the dry cellulose filaments can be easily re-dispersed into aqueous solution/suspension to be used in many applications, such as for reinforcement of paper products, composite materials, cement, painting and coating.

In accordance with yet another aspect described herein, the natural fibres used to inhibit irreversible hydrogen bonding between cellulose filaments include all wood and plant fibres produced by known methods, such as chemical and mechanical pulping methods.

In accordance with yet another aspect described herein, there is provided the dry cellulose filaments, that are free of chemical additives and free of derivatization.

In accordance with one embodiment described herein, there is provided a method to produce a dry re-dispersible cellulose filament (CF)/carrier mixed product wherein the CF retains their dispersibility in water and hence their superior reinforcement ability in papermaking furnishes, composite materials, or other materials where CF is applied.

The method comprises (i) dispersing never-dried cellulose filaments at a lower consistency, (ii) dispersing certain amount of natural pulp fibres and mixing dispersed pulp fibres with dispersed cellulose filaments suspension, or adding dry natural fibres into dispersed cellulose filaments suspension and further dispersing the mixture of cellulose filaments and natural fibres, (iii) pressing/thickening certain amount of the mixture slurry of cellulose filaments and natural fibres to a consistence of about 20-50%, (iv) fluffing certain amount of the thickened cellulose filaments and natural fibres mixture, (v) drying certain amount of the fluff cellulose filaments and natural fibres mixture.

In accordance with another embodiment, there is provided the method herein described, wherein the ratio of cellulose filaments verse to natural fibres ranged from 1/99 to 99/1, preferably in the range of from about 1/99 to about 50/50, most preferably in the range of from about 10/90 to about 30/70.

In accordance with another embodiment, there is provided the method herein described, further comprising drying a certain amount of the fluff cellulose filaments and natural fibre mixture by any commercial pulp drying process, preferably by flash dryer, spray dryer or steam dryer, most preferably by flash dryer.

In accordance with another embodiment, there is provided the method herein described, wherein the dried cellulose filaments in the mixture of dry cellulose filaments and natural fibres can be easily re-dispersed in aqueous suspension by laboratory and commercial scale dispersion, pulping and/or refining equipment, such as laboratory British disintegrator, helico pulpers, hydropulpers, pilot and industrial pulpers, refiners depending on the ratio of dry cellulose filament in the mixture of cellulose filaments and natural fibres.

In accordance with another embodiment, there is provided the method herein described, wherein the handsheets made from the re-dispersed mixture of cellulose filaments and natural fibres before and after drying were prepared.

In accordance with another embodiment, there is provided the method herein described, wherein the dry cellulose filaments in the mixture of cellulose filaments and natural fibres were used as reinforcement agent for weak pulps.

In accordance with another embodiment, there is provided the method herein described, therein the handsheets made from the re-dispersed mixture of cellulose filaments and natural fibres as well as other weak pulps before and after drying were prepared.

In accordance with another embodiment, there is provided the method herein described, therein the physical strength of prepared handsheets were measured and compared for both before and after drying.

In accordance with another embodiment, there is provided the method herein described, therein the results show that the reinforcement power of dry cellulose filaments in the mixture of dry cellulose filaments and natural fibres is comparative with the never-dried cellulose filaments.

According to another aspect, dry and water re-dispersible cellulose filaments carried by nature fibres described herein have advantages for the transportation, storage or subsequent use of the CF material.

According to yet another aspect, dry and water re-dispersible of mixture of cellulose filaments and natural fibres described herein is used, upon re-dispersion in an aqueous medium, as an additive for reinforcing cellulose fibres products such as paper, tissue and paperboard, for manufacturing composites and packaging or other applications. They can also be used, upon re-dispersion in an aqueous medium, as an additive to reinforce other consumer or industrial products.

Unless otherwise indicated, the definitions and embodiments described in this and other sections are intended to be applicable to all embodiments and aspects of the present disclosure herein described for which they are suitable as would be understood by a person skilled in the art.

As used in the present disclosure, the singular forms "a", "an" and "the" include plural references unless the content clearly dictates otherwise.

In embodiments comprising an "additional" or "second" component, the second component as used herein is different from the other components or first component. A "third" component is different from the other, first, and second components, and further enumerated or "additional" components are similarly different.

Terms of degree such as "about" and "approximately" as used herein mean a reasonable amount of deviation of the modified term such that the end result is not significantly changed. These terms of degree should be construed as including a deviation of at least ±5% or at least ±10% of the modified term if this deviation would not negate the meaning of the word it modifies.

The terms "cellulose filaments" or "CF" and the like as used herein refer to filaments obtained from cellulose fibres having a high aspect ratio, for example, an average aspect ratio of at least about 200, for example, an average aspect ratio of from about 200 to about 5000, an average width in the nanometer range, for example, an average width of from about 30 nm to about 500 nm and an average length in the micrometer range or above, for example, an average length above about 10 μm, for example an average length of from about 200 μm to about 2 mm. Such cellulose filaments can be obtained, for example, from a process which uses mechanical means only, for example, the methods disclosed in US Pat. Application No. 2013/0017394. For example, such method produces cellulose filaments that can be free of chemical additives and free of derivatization using, for example, a conventional high consistency refiner operated at solid concentrations (or consistencies) of at least about 20 wt %. These strong cellulose filaments are, for example, under proper mixing conditions, re-dispersible in an aqueous medium. For example, the cellulose fibres from which the cellulose filaments are obtained can be but are not limited to Kraft fibres such as Northern Bleached Softwood Kraft (NBSK), but other kinds of suitable fibre are also applicable, the selection of which can be made by a person skilled in the art.

The "never-dried" CFs is defined that cellulose filaments have never been dried and have remained in a wet stage with up to 60% solids by weight after their production from wood or plant fibres with the method of Hua et al. (US Pat. Application No. 20130017394), and note the appropriate treatment can become a dry re-dispersion cellulose filament.

The term "carrier" defines a fibre that is generally natural and in a preferred embodiment of a pulp fibre. The pulp may derive from wood or other plants, and may be mechanical pulps, such as CTMP, TMP or BCTMP or chemical pulps, such as NBSK.

The term "physically attached" is used herein by reference to the bond between the re-dispersible cellulose filament and the carrier.

The term "reversibly integrated" is defined here as the "physical attachment" or "integration" between the cellulose filament and the carrier, which comprises mild agitation.

The term "dry" as defined herein in reference to the filaments described herein refers to a solid content of the mixture of cellulose filaments and natural fibres being no less than 70% by weight solids, or a moisture content of no more than 30% by weight. In a particularly preferred embodiment the solids content of the mixture of cellulose filament and natural fibres is no less than 80% by weight solids, or a moisture content of no more that 20% by weight.

The term "water re-dispersible" as defined herein refers to the ability of the dried cellulose filaments to form a stable water dispersion upon mechanical agitation in an aqueous medium at ambient or an elevated temperature.

The expressions "reinforcement power and/or strength properties similar to" are defined herein to be comparative expressions that indicate that no less than 85% of the said reinforcement power and/or strength properties of the CF described herein are obtained in paper when compared to the same quantity of never-dried CFs.

The term "free of additives" is used herein to describe CFs that have not been treated with additives to reduce hornification. The additives that are used with other cellulose fibril include sucrose, glycerin, ethylene glycol, dextrin, carboxymethyl cellulose or starch (U.S. Pat. No. 4,481,076).

The term "consistency" is defined herein as the weight percentage of plant fibres or cellulose filaments (CF) in a mixture of water and, plant fibres or cellulose filaments (CF).

The term "basis weight" is defined herein, as the weight in grams (g) of sheets of pulp fibres and CF per square meter ($m^2$) of the said sheets.

A weight that is oven-dried (od) basis refers to the weight that excludes the weight of water. For a moist material such as CF, it is the water-free weight of the material that is calculated from its consistency.

The present process is illustrated by, but not limited to, the following general procedures:

General Procedure A: Dispersion of Never-Dried CF

Option 1—Dispersion of Never-Dried CF in Laboratory

Unless otherwise specified, the never-dried CF was dispersed in laboratory using a standard pulp disintegrator based on PAPTAC Standard C.4 and C.5. 24 g oven-dried (od basis) of CF with an average length of from about 200 μm to about 2 mm, an average width of from 30 nm to about 500 nm and an average aspect ratio of from about 200 to about 5000 and a consistency of 20-60% made from multi-pass, high consistency refining of a bleached softwood kraft pulp, was diluted to 1.2% consistency in a British Disintegrator with a known amount of deionized water (DI $H_2O$), the temperature of which had been raised to 80° C. The CF slurry was mixed at 3000 rpm for 15 minutes to give a dispersion which was then removed from the Disintegrator. The dispersed CF was then diluted to a desired consistency.

Option 2—Dispersion of Never-Dried CF in Pilot Pulper

Unless otherwise specified, up to 120 kg (od basis) of CF described in General procedure A, Option 1, was diluted to 3.0-6.0% consistency in a pilot paper machine Press Broke Pulper (Beloit Vertical Tri-Dyne Pulper, Model No. 5201, Serial No. BC-1100) or a Dry-end Pulper with a known amount of tap $H_2O$, the temperature of which had been raised to ~50° C. The CF slurry was mixed at 480 rpm for 15 minutes to give a dispersion which was removed from the pulper and stored in a storage tank.

General Procedure B: Pulp Disintegration

Option 1—Pulp Carrier Dispersion in Laboratory

Unless otherwise specified, pulp was dispersed in laboratory using a standard pulp disintegrator based on PAPTAC Standard C.4 and C.5. 24 g oven-dried (od basis) of pulp was first soaked in water for a period of at least 4 hours before disintegration and then diluted to 1.2% consistency in a British Disintegrator with a known amount of deionized water (DI $H_2O$). The disintegrator was started at 3000 rpm until the pulp is free of fibre bundles. Normally, the disintegration time does not exceed 25 minutes.

The dispersed pulp carrier suspension was then mixed with previously dispersed CF suspension according to CF/pulp carrier ratio. The ratio of CF/pulp carrier varied from 0/100, 10/90, 20/80, 30/70, 40/60, 50/50, 60/40, 70/30, 80/20, 90/10, 100/0.

Option 2A—Pulp Carrier Dispersion in Pilot Pulper

Unless otherwise specified, up to 120 kg (od basis) of pulp was diluted to 4.0-10.0% consistency in a pilot paper machine Press Broke Pulper (Beloit Vertical Tri-Dyne Pulper, Model No. 5201, Serial No. BC-1100) or a Dry-end Pulper with a known amount of tap $H_2O$, the temperature of which had been raised to ~50° C. The pulp slurry was mixed at 480 rpm for 15 minutes to give a dispersion which was removed from the Pulper and stored in a storage tank.

The dispersed pulp carrier was then mixed with previously dispersed CF suspension according to CF/pulp ratio. The ratio of CF/pulp carrier varied from 0/100, 10/90, 20/80, 30/70, 40/60, 50/50, 60/40, 70/30, 80/20, 90/10, 100/0.

For Option 2B—A certain amount of dry-lap of pulp (calculated based on CF/BCTMP ratio) with known amount of water were added into the pre-dispersed CF suspension in the pilot paper machine Press Broke Pulper or Dry-end Pulper based on CF/pulp ratio, and further dispersed in the pulper.

General Procedure C: Thickening of the CF/Pulp Mixture

Option 1—Thickening of the CF/Pulp Mixture in Laboratory

Unless otherwise specified, the CF/pulp mixture was thickened/pressed using a laboratory vertical pulp press. A known amount of wet CF/pulp was put inside a laboratory cloth bag and pressed at the desire pressure. The filtrate volume was monitored during the press to calculate the consistency of the pressed pulp mat. Pressing is stopped once the desired consistency (30-35%) was obtained.

Option 2—Thickening of the CF/Pulp Mixture in Pilot-Scale Screw Press

Unless otherwise specified, a pilot plant screw press was used to concentrate the well mixed CF/pulp slurry from about 4% to about 20-50% consistency. The thickening process was highly affected by the ratio of CF in the CF/pulp mixture due to the high water retention value of the cellulose filaments. Operating conditions and production rate for thickening the CF/pulp mixture was adjusted for each CF/pulp ratio. A pulp mat of CF/pulp mixture was obtained from the outlet of the screw press with a consistency of 20-50%.

General Procedure D: Fluffed the CF/Pulp Mat Prior to Drying

Unless otherwise specified, the wet mat of CF/pulp mixture after pressing was fed into a pilot-scale fluffer to get a fluff CF/pulp mixture for drying with any commercial pulp fibre dryer.

General Procedure E: Dry of CF/Pulp Mixture

Option 1—Dry of CF/Pulp Mixture in Laboratory

Unless otherwise specified, the fluffed CF/pulp mixture was dried in a Hobart mixer sitting on a hot plate and blown with hot air from top at a medium mixing speed. This drying method produced dry fine particles of CF-containing pulp, which were very similar to the dry products produced with industrial pulp dryers, such as flash dryer.

Option 2—Dry of CF/Pulp Mixture in Pilot Flash Dryer

Unless otherwise specified, the fluffed CF/pulp mixture was dried using GEA's pilot flash dryer whose configuration can be adapted to dry powdery products. Detailed description of the standard configurations of the machine for flash dryer of Barr-Rosin, a division of GEA Canada Inc. have been presented in the report of "Drying Systems and Energy Integration" by Barr-Rosin, division of GEA Canada Inc. (May 12, 2012).

Unless otherwise specified, the feed rate of CF/pulp is 100 kg/h and the moisture content of the feed was 50-75%. The product rate was in the range of 30-40 kg/h depending on the initial moisture content of the feed CF/pulp. The inlet temperature was 170-191° C. and the exhaust temperature was adjusted to as needed to reach final moisture targets.

General Procedure F: Re-Dispersion of Dry Cellulose Filaments Carried by Nature Fibres Option 1—Normal Re-Dispersion Procedure Dry cellulose filaments carried by nature fibres were normally dispersed following the General Procedure A for dispersion of never-dried cellulose filaments.

Option 2—Re-Dispersion of Dry CF Carried by Nature Fibres by Refining

In case that dry CF/pulp containing high ratio of cellulose filaments cannot be fully dispersed with General Procedure A, a low consistency refiner (Escher Wyss R1L Laboratory refiner) was used to disperse the dry CF/pulp. The Escher Wyss R1L Laboratory refiner is a closed loop conical refiner based on the Jordan refiner. The dried CF/pulp carrier products were soaked for minimum 4 hours prior to low consistency refining. The refining consistency was 3% and the dispersion time was 15-30 seconds. All refining was done at room temperature 20-23° C. and target specific edge load (SEL, J/m) is 0.3 J/m.

General Procedure G: Preparation of Handsheets from Dried CF Carried by Pulp Fibres (Before and after Drying) as Well as for CF Reinforcement of HWK Unless otherwise specified, a hardwood kraft pulp (HWKP) in a dry-lap from was first combined with deionized water (DI water) and repulped/disintegrated in a helico pulper at 10% consistency, 800 rpm and 50° C. for 15 minutes. The repulped HWKP was then combined with a sample of CF dispersion prepared according to General Procedure A, Option 1, at a weight (od basis) ratio of 5/95 (CF/HWKP) or with a sample of re-dispersed dried CF/pulp suspension and with DI $H_2O$ to give a slurry at 0.33% consistency. Handsheets (60 g/m$^2$) were prepared according to PAPTAC Test Method, Standard C.4. Tensile, TEA and tear strengths were determined according to PAPTAC Test Method, Standard D. 34. In a separate experiment, handsheets (60 g/m$^2$) from 100% HWKP were also prepared and their tensile strengths, TEA and tear strengths were measured.

EXAMPLES

The following examples are presented to describe the present product and to carry out the method for producing the said dry and water re-dispersible cellulose filaments carried by natural fibres. These samples should be taken as illustrative and are not meant to be limitative.

Example 1. Manufacturing Dry and Water Re-Dispersible Cellulose Filaments Carried by BCTMP at Pilot Scale Cellulose filaments dried using conventional pulp drying methods are only partially re-dispersible in aqueous system and therefore loss its reinforcement power, when compared with never-dried cellulose filaments.

BCTMP pulp fibres were used as CF carrier during drying process to prevent hornification of cellulose filaments, which may also produce super BCTMP market pulp.

The objectives were to assess if BCTMP containing different proportions of CF can be dried by a conventional pulp flash dryer, to evaluate the re-dispersibility of flash dried CF/BCTMP, and to compare the performance of CF in dry CF/BCTMP with never-dried CF.

Cellulose filaments (CF) was prepared to have an average length of from about 200 μm to about 2 mm, an average width of from 30 nm to about 500 nm and an average aspect ratio of from about 200 to about 5000 produced from a bleached softwood kraft pulp by multi-pass, high consistency (30-35%) refining with a total specific refining energy 8000-~8500 kilowatts hour per ton of pulp (kWh/t) using the method previous described in US Pat. Application No. 20130017394. The CF prepared, at a consistency of 30-35%, is referred to as never-dried CF.

A sample (up to 120 kg od basis) of the never-dried CF was used to produce dry CF/BCTMP according General Procedures A to E, Options 2 described.

A sample (24 g od basis) of the never-dried CF was dispersed in DI water according to General Procedure A, Option 1 described. The stable suspension of CF is referred to as Dispersed Never-dried CF.

A sample (24 g od basis) of the CF/BCTMP before flash drying was dispersed in DI water according to General Procedure A, Option 1 described. The stable suspension of CF/BCTMP is referred to as Dispersed Never-dried CF/BCTMP.

A sample (24 g od basis) of the flash dried CF/BCTMP was dispersed in DI water according to General Procedure A, Option 1 described. The CF/BCTMP slurry is referred to as Re-slushed Dried CF/BCTMP.

A sample (24 g od basis) of hardwood kraft pulp (HWK) was dispersed in DI water according to General Procedure B, Option 1 described 4% of Dispersed Never-dried CF, Dispersed Never-dried CF/BCTMP and Reslushed Dried CF/BCTMP were added into the HWK, respectively, to compare the reinforcement power of CF in dried CF/BCTMP to never-dried CF.

Handsheets from CF/BCTMP (before and after drying) as well as using CF as reinforcing agent for HWK were prepared according to General procedure G. Tensile and tear strengths as well as TEA index were determined according to PAPTAC Test Method, Standard D. 34. In a separate experiment, handsheets (60 g/m$^2$) from 100% HWKP were also prepared and their tensile, TEA and tear strengths were measured.

Figures 5A, 5B, 5C:
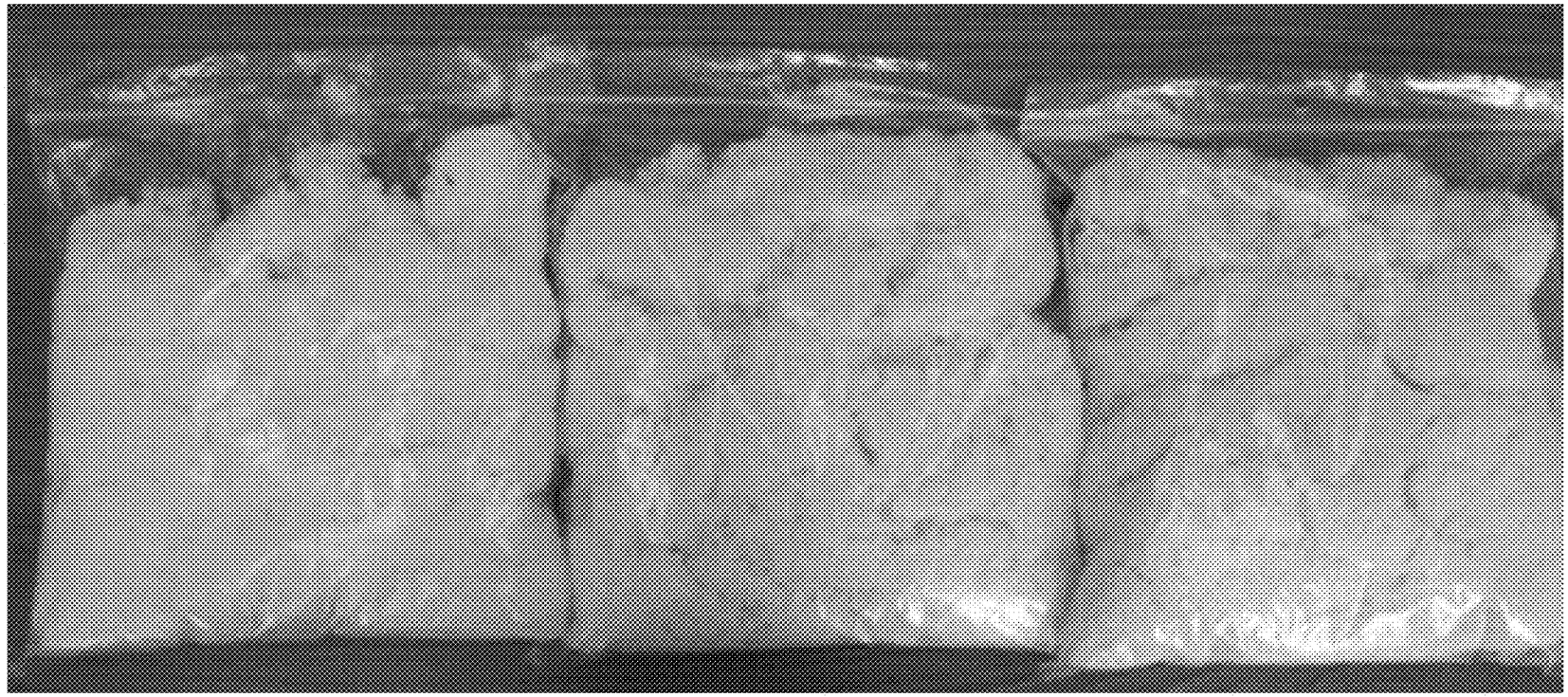
FIG. 5*a* is a photograph of flash dried product of cellulose filaments and natural carrier fibres CF/BCTMP (10/90) where the small dried particles of mixture of cellulose filaments and natural fibres can be easily re-dispersed in aqueous system, in accordance with one embodiment described herein.
FIG. 5*b* is a photograph of flash dried product of cellulose filaments and natural carrier fibres CF/BCTMP (30/70) where the small dried particles of mixture of cellulose filaments and natural fibres can be easily re-dispersed in aqueous system, in accordance with one embodiment described herein.
FIG. 5*c* is a photograph of flash dried product of cellulose filaments and natural carrier fibres CF/BCTMP (50/50) where the small dried particles of mixture of cellulose filaments and natural fibres can be easily re-dispersed in aqueous system, in accordance with one embodiment described herein.

The weight ratio of CF/BCTMP varied from 0/100, 10/90, 30/70, 50/50, 70/30, 80/20, 90/10, 100/0. Among these samples, the drying of 100% BCTMP required lowest energy to achieve the desired moisture content of about 15%. The amount of energy required to dry CF/BCTMP (90/10) was about 1.4 times more than that needed for drying 100% BCTMP. FIG. 5 shows the pictures of flash dried CF/BCTMP with the CF/BCTMP ratio of 10/90, 30/70 and 50/50 as indicated in the figure.

Table 1 presents the tensile strength of handsheets made from Dispersed Never-dried CF/BCTMP (before flash drying) and Re-slushed Dried CF/BCTMP (after flash drying). The results show that, when CF ratio less than 30%, tensile strength of Re-slushed Dried CF/BCTMP was similar to that of Dispersed Never-dried CF/BCTMP. On the other hand, when CF ratio beyond 30%, tensile strength of Re-slushed Dried CF/BCTMP was much lower than that of Dispersed Never-dried CF/BCTMP. The difference in tensile strength between the Dispersed Never-dried and Reslushed Dried CF/BCTMP increased with increasing CF ratio. In addition, non-dispersible CF bundles were observed in the Re-slushed Dried CF/BCTMP when CF ratio was 70% and higher. When CF ratio is too high (higher than 70%), there were not enough fibres to inhibit the formation of irreversible hydrogen bonds between the cellulose filaments during drying, which lead to formation of CF bundles.

TABLE 1

Tensile strength of handsheets made from Dispersed Never-dried CF/BCTMP and Re-slushed Dried CF/BCTMP.

| | Tensile Strength (N · m/g) | |
|---|---|---|
| CF/BCTMP | Dispersed Never-dried CF/BCTMP | Re-slushed Dried CF/BCTMP |
| 0/100 | 16.1 | 17.9 |
| 10/90 | 38.1 | 36.8 |
| 30/70 | 57.9 | 53.8 |
| 50/50 | 77.0 | 67.6 |
| 70/30 | 86.7 | 71.1 |
| 80/20 | 101.5 | 73.6 |
| 90/10 | 106.3 | 51.7 |

Table 2 lists the tensile and tear strengths of handsheets made from HWK reinforced by Dispersed Never-dried CF, Dispersed Never-dried CF/BCTMP (before flash drying) and Re-slushed Dried CF/BCTMP (after flash drying) at CF/BCTMP ratio of 10/90 and 30/70. For comparison purpose, CF ratio was controlled at 4% and the ratios of other pulp components were varied as indicated in the table, due to the different ratios of CF/BCTMP used in this example. The results show that, when CF ratio less than 30%, the tensile and tear strengths of the handsheets reinforced by Dispersed Never-dried CF or by Re-slushed Dried CF/BCTMP were very similar. Thus, the reinforcement power of CF in Re-slushed Dried CF/BCTMP was similar to that of Dispersed Never-dried CF.

TABLE 2

Tensile and tear strengths of handsheets made from HWK reinforced by Dispersed Never-dried CF and Re-slushed Dried CF/BCTMP (after flash drying) at CF/BCTMP ratio of 10/90 and 30/70.

| | Tensile Index (N · m/g) | | Tear Index (mN · $m^2$/g) | |
|---|---|---|---|---|
| Handsheet | Dispersed Never-dried CF | Reslushed Dried CF/BCTMP | Dispersed Never-dried CF | Reslushed Dried CF/BCTMP |
| 4% CF 36% BCTMP 60% HWKP | 30.3 | 30.9 | 6.7 | 7.4 |
| 4% CF 9.3% BCTMP 86.7% HWKP | 34.2 | 34.0 | 8.4 | 8.1 |

Figure 6C:
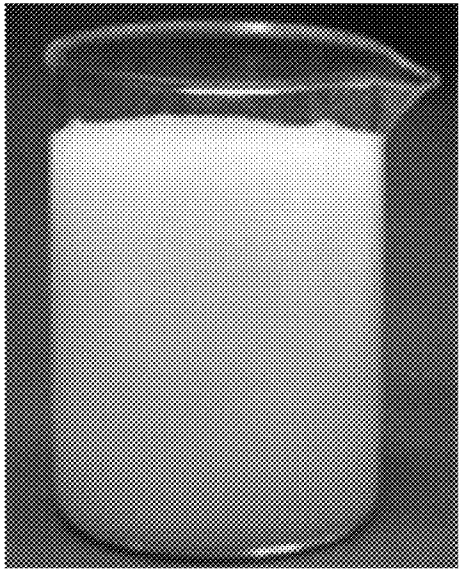
FIG. 6*c* are re-dispersed cellulose filament and natural fibre slurry (when CF ratio higher than 30%).
Figure 6B:
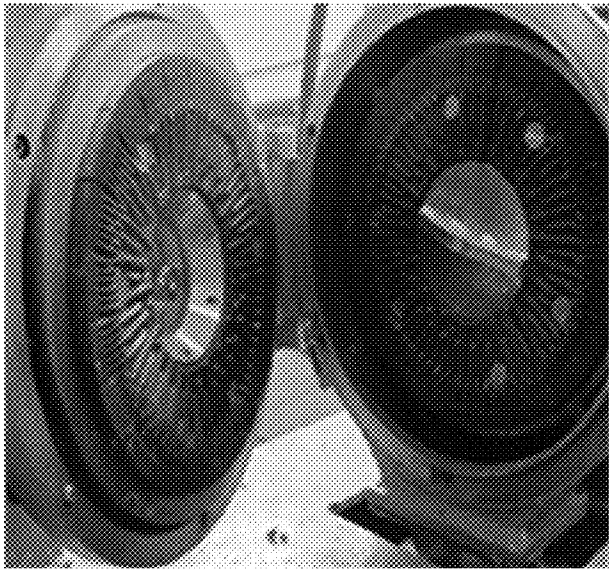
FIG. 6*b* is a photograph of plates of a laboratory low consistency refiner.
Figure 6A:
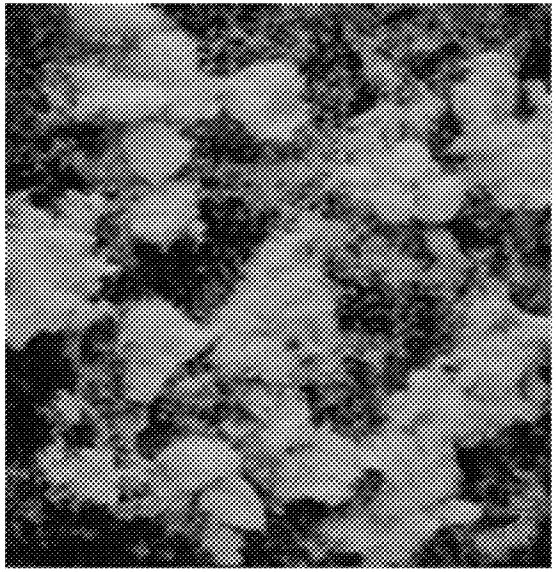
FIG. 6*a* is a photograph of flash dried mixture of cellulose filaments and natural carrier fibres.

It was observed that Re-slushed Dried CF/BCTMP (90/10) and CF/BCTMP (100/0) contained non-dispersible CF bundles. Thus, the Dried CF/BCTMP (90/10) and CF/BCTMP (100/0) were also refined using a low consistency refiner at 120 kWh/t for CF/BCTMP (90/10) and 200 kWh/t for CF/BCTMP (100/0), respectively according to General Procedure F, Option 2 described. The flash-dried CF/BCTMP, the low consistency refiner plate and CF/BCTMP after refining are shown in FIG. 6.

The TEA and tear strengths of handsheets made from 100% HWK, 95% HWK plus 5% Dispersed Never-dried CF, and 95% HWK plus 5% refined dried CF (CF/BCTMP: 90/10 and 100/0) are presented in Table 3. The results showed that the TEA and tear strengths of handsheets reinforced by 5% refined dried CF (re-dispersed at specific energy of about 120 kWh/t for CF/BCTMP (90/10) and 200 kWh/t for CF/BCTMP (100/0)) were similar to those reinforced by Dispersed Never-dried CF. Thus, low consistency refiner can re-disperse the dried CF or CF/BCTMP.

TABLE 3

TEA and tear strengths of handsheets made from 100% HWK, 95% HWK plus 5% Dispersed Never-dried CF, and 95% HWK plus 5% refined dried CF in dried CF/BCTMP.

| Sample | TEA Strength (mJ/g) | Tear Strength (mNm$^2$/g) |
|---|---|---|
| HWK | 351.2 | 7.2 |
| HWK + 5% Dispersed Never-Dried CF | 740.7 | 8.1 |
| HWK + 5% refined dried CF from CF/BCTMP (90/10) | 766.0 | 7.9 |
| HWK + 5% refined dried CF from CF/BCTMP (100/0) | 809.0 | 8.3 |

Example 2. Manufacturing Dry and Water Re-Dispersible Cellulose Filaments Carried by NBSK at Pilot Scale NBSK pulp fibres were used as CF carrier during drying process to prevent hornification of cellulose filaments, which may also produce super NBSK market pulp.

The objectives were to assess if NBSK containing different proportions of CF can be dried by a conventional pulp flash dryer, to evaluate the re-dispersibility of flash dried CF/NBSK, and to compare the performance of CF in dry CF/NBSK with never-dried CF.

Cellulose filaments used for this example and the procedure of making dry CF/NBSK are the same as in Example 1.

Figure 7C:
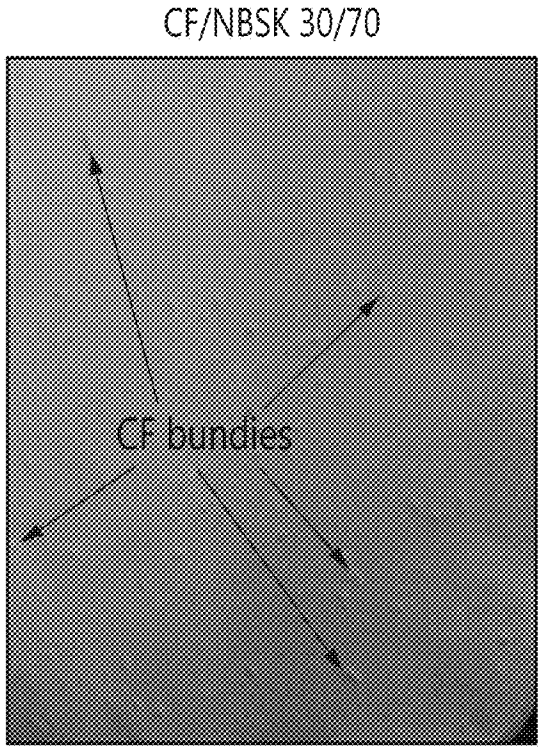
FIG. 7*c* illustrates the surface of a handsheet prepared from CF/NBSK with a weight ratio of 70/30 after flash drying in accordance with one embodiment described herein, where the CF bundles are observed on the surface of the handsheet.
Figure 7B:
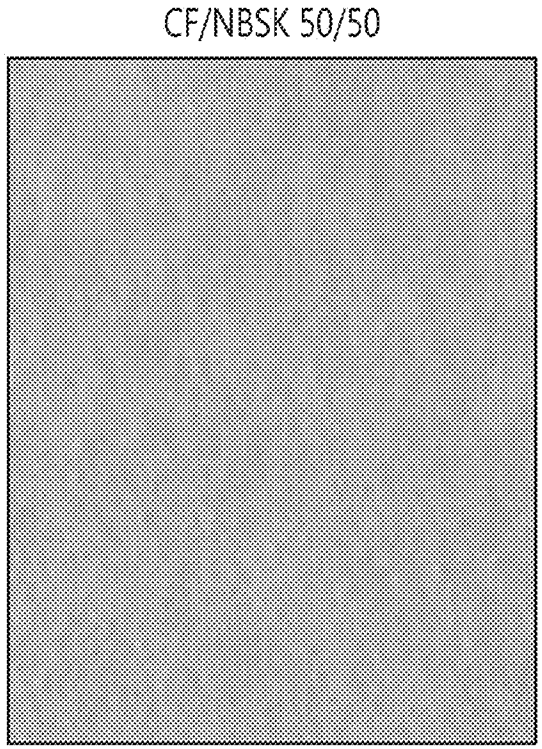
FIG. 7*b* illustrates the surface of a handsheet prepared from CF/NBSK with a ratio of 50/50 in accordance with one embodiment described herein, having a smooth surface.
Figure 7A:
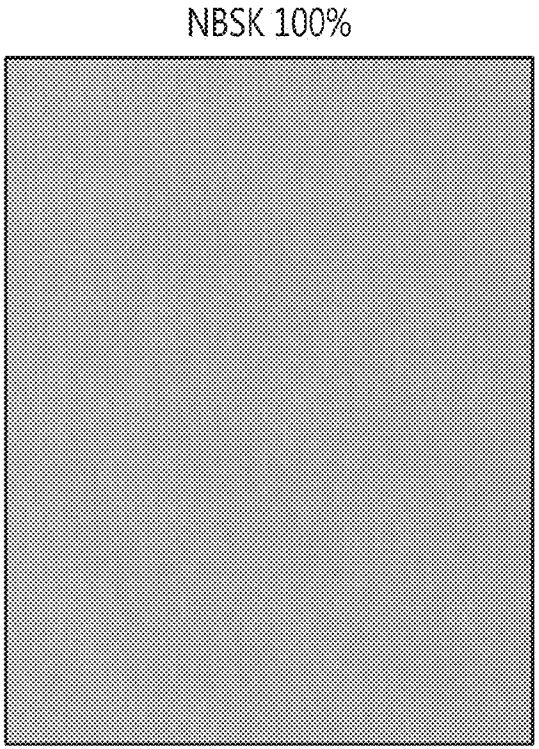
FIG. 7*a* illustrates the surface of a handsheet prepared from NBSK (100%) in accordance with one embodiment described herein, having a smooth surface.

Table 4 presents the tensile strength of handsheets made from Dispersed Never-dried CF/NBSK (before flash drying) and Re-slushed Dried CF/NBSK (after flash drying). The results show that, when CF ratio less than 30%, tensile strength of Re-slushed Dried CF/NBSK was similar to that of Dispersed Never-dried CF/NBSK. On the other hand, when CF ratio beyond 30%, tensile strength of Re-slushed Dried CF/NBSK was much lower than that of Dispersed Never-dried CF/NBSK. The difference in tensile strength between the Dispersed Never-dried CF/NBSK and the Re-slushed Dried CF/NBSK increased with increasing CF ratio. In addition, non-dispersible CF bundles were observed in the Re-slushed Dried CF/NBSK when CF ratio was 70% and higher, as shown in FIG. 7. FIG. 7*a* and FIG. 7*b* illustrate handsheets prepared with 100% NBSK and 50% CF/50% NBSK, each having smooth surfaces. FIG. 7*c* illustrates a handsheet with 70% CF/30% NBSK having a less smooth surface that includes visible CF bundles that appear as small nodules protruding from the surface of the handsheet.

TABLE 4

Tensile strength of handsheets made from Dispersed Never-dried CF/NBSK and Re-slushed Dried CF/NBSK.

| | Tensile Strength (N · m/g) | |
|---|---|---|
| CF/NBSK | Dispersed Never-dried CF/NBSK | Re-slushed Dried CF/NBSK |
| 0/100 | 30.71 | 29.34 |
| 10/90 | 47.36 | 44.80 |
| 30/70 | 71.30 | 60.34 |
| 50/50 | 79.78 | 71.23 |
| 70/30 | 91.25 | 76.11 |
| 80/20 | 102.00 | 78.66 |
| 90/10 | 110.87 | 81.93 |

Table 5 lists the tensile and tear strengths of handsheets made from 100% HWK, HWK reinforced by NBSK or by Re-slushed Dried CF/NBSK at CF/NBSK ratios of 10/90 and 30/70, respectively. The results show that the tensile and tear strengths of the handsheets reinforced by NBSK or dry CF in the dried CF/BCTMP increased with CF ratio.

TABLE 5

Tensile and tear strengths of handsheets made from 100% HWK, HWK reinforced by 25% NBSK or by 25% Re-slushed Dried CF/NBSK at CF ratio of 10% and 30%.

| Handsheet type | Tensile Index (N · m/g) | Tear Index (mJ/g) |
|---|---|---|
| HWK 100% | 14.28 | 1.66 |
| HWK/NBSK 75/25 | 16.57 | 5.65 |
| HWK/Dried CF-NBSK 75/25(CF/NBSK: 10/90) | 18.51 | 6.65 |
| HWK/Dried CF-NBSK 75/25(CF/NBSK: 30-70) | 25.28 | 7.30 |

Flash dried CF/NBSK (90/10) containing non-dispersible CF bundles up on normal dispersion procedure were re-dispersed using a low consistency refiner at 200 kWh/t according to General Procedure F, Option 2 described.

The TEA and tear strengths of handsheets made from Dispersed Never-dried CF/NBSK, Re-slushed Dried CF/NBSK with normal re-dispersion procedure and Refined Dried CF/NBSK are presented in Table 6. The results showed that the tensile and TEA strengths of handsheets decreased by 25% for Re-slushed Dried CF/NBSK (re-slushed with normal re-dispersion procedure) due to undispersed CF bundles. Refining using low consistency refiner at specific refining energy of about 200 kWh/t fully re-dispersed the dried CF/NBSK (90/10), thus increasing the tensile and TEA strengths of handsheets to the same level as Dispersed Never-dried CF/NBSK (90/10).

TABLE 6

Tensile and TEA strengths of handsheets made from Dispersed Never-dried CF/NBSK (90/10), Re-slushed Dried CF/NBSK (90/10) with normal re-dispersion procedure and Refined Dried CF/NBSK (90/10).

| Sample | Tensile Strength (N · m/g) | TEA Strength (mJ/g) |
|---|---|---|
| Dispersed Never Dried CF/NBSK (90/10) | 110.9 | 4097 |
| Re-slushed Dried CF/NBSK (90/10) | 81.9 | 2911 |
| Refined Dried CF/NBSK (90/10) | 110.8 | 3896 |

Example 3. Comparison Re-Slushed Dried CF/NBSK with the Mixture of Dried CF and of Dried NBSK The present example compares the performance of flash-dried CF/NBSK with the mixture of flash-dried CF and of flash-dried NBSK. Cellulose filaments used for this example and the procedure of making dry CF/NBSK, dry CF and dry NBSK in Example 1.

Figure 8:
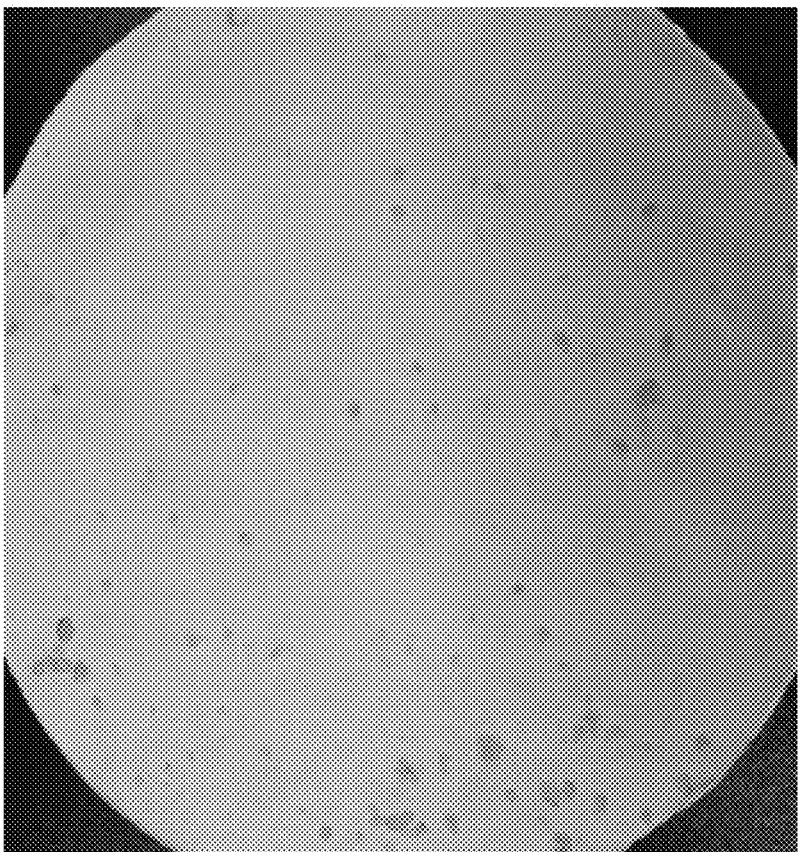
FIG. 8 is a photograph of a handsheet made from a mixture of dried CF (30%) and of dried NBSK (70%) where a large number of CF clumps are present.

Table 7 presents the tensile strength of handsheets made from Re-slushed Dried CF/NBSK (after flash drying) and from the mixture of dried CF and of dried NBSK. The results show that the tensile strength of Re-slushed Dried CF/NBSK was much higher than those of the mixture of dried CF and of dried NBSK. FIG. 8 illustrates handsheet prepared from the mixture of dried CF (30%) and of dried NBSK (70%) having a very rough surface that includes a large amount of non-dispersible CF bundles.

TABLE 7

Tensile strength of handsheets made from Re-slushed Dried CF/NBSK and from the mixture of dried CF and of dried NBSK.

| | Tensile Strength (N · m/g) | |
|---|---|---|
| CF/NBSK | Re-slushed Dried CF/NBSK | Re-slushed mixture of dried CF and of dried NBSK |
| 10/90 | 44.80 | 11.68 |
| 30/70 | 60.34 | 10.22 |

The invention claimed is:

1. A dry mixed product comprising
re-dispersible cellulose filaments and
a carrier fibre,
the dry mixed product comprising a re-dispersible cellulose filaments/carrier fibre weight ratio of about 1/99 to about 99/1,
a humidity of less than 30 weight % and
wherein the re-dispersible cellulose filaments are physically attached and reversibly integrated with the carrier fibre, permitting re-dispersion of the re-dispersible cellulose filaments in aqueous phase.

2. The dry mixed product of claim 1, wherein the weight ratio of the re-dispersible cellulose filaments/carrier fibre is about 1/99 to about 50/50.

3. The dry mixed product of claim 1, wherein the weight ratio of the re-dispersible cellulose filaments/carrier fibre is about 10/90 to about 30/70.

4. The dry mixed product of claim 1, wherein the humidity is less than 20 weight %.

5. The dry mixed product of claim 1, wherein the carrier fibre is selected from mechanical pulp or chemical pulp.

6. The dry mixed product of claim 5, wherein the mechanical pulp is thermomechanical pulp, chemi-thermomechanical pulp, a ground wood pulp or bleached chemi-thermomechanical pulp.

7. The dry mixed product of claim 5, wherein the chemical pulp is bleached softwood, hardwood kraft pulp, non-bleached kraft pulp and/or sulfite pulp.

8. A process of producing a reinforced paper, tissue and/or packaging product comprising:
providing a dry mixed product of claim 1;
providing a paper making pulp;
re-dispersing cellulose filaments from the dry mixed product in water to produce a mixed product suspension;
the paper making pulp with water to make a pulp suspension
combining the mixed product suspension with the pulp suspension to make a reinforced paper slurry,
depositing the reinforced paper slurry to produce the reinforced paper, tissue and/or packaging product.

9. The process of claim 8, wherein the mixed product suspension with the pulp suspension are combined at a weight ratio of solids from 1/99 to 99/1.

10. A process for producing a reinforced product comprising
providing a dry mixed product of claim 1, and
mixing the dry mixed product with a starting material of the reinforced product.

11. The process of claim 10, wherein the reinforced product is selected from the group consisting of a composite material; a gypsum; a cement; a concrete products; a fibre board, a paint; and a coating.

12. The process of claim 10, wherein the mixed product is in a suspension with the starting material and combined in a weight ratio of solids from 1/99 to 99/1.

13. The dry mixed product of claim 1, comprising cellulose filaments having an average length of from about 200 μm to about 2 mm.

14. The dry mixed product of claim 1, comprising cellulose filaments having an average length of from about 30 nm to about 500 nm.

15. The dry mixed product of claim 1, comprising cellulose filaments free of chemical additives and free of derivatization.

16. The dry mixed product of claim 1, comprising cellulose filaments having an average aspect ratio of from about 200 to about 5000.

* * * * *